US006488009B2

(12) United States Patent
Sakurai et al.

(10) Patent No.: US 6,488,009 B2
(45) Date of Patent: Dec. 3, 2002

(54) THROTTLES

(75) Inventors: Toru Sakurai, Obu (JP); Tsutomu Nishitani, Obu (JP); Takashi Tsuge, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/840,835

(22) Filed: Apr. 25, 2001

(65) Prior Publication Data

US 2001/0032616 A1 Oct. 25, 2001

(30) Foreign Application Priority Data

Apr. 25, 2000 (JP) ..... 2000-124695

(51) Int. Cl.[7] ..... F02D 9/02
(52) U.S. Cl. ..... 123/399; 123/361
(58) Field of Search ..... 123/361, 399

(56) References Cited

U.S. PATENT DOCUMENTS 4,130,608 A * 12/1978 Ota ..... 261/41.3
5,571,960 A 11/1996 Tateishi et al.
5,735,243 A 4/1998 Asai et al.
5,906,185 A 5/1999 Ishida et al.
5,983,858 A * 11/1999 Hashimoto et al. ..... 123/399
6,070,458 A 6/2000 Nawa et al.
6,079,390 A * 6/2000 Hashimoto et al. ..... 123/399
6,116,214 A 9/2000 Ishida
6,153,952 A 11/2000 Ito et al.
6,164,623 A 12/2000 Ito et al.

FOREIGN PATENT DOCUMENTS

JP 3271528 12/1991

* cited by examiner

*Primary Examiner*—Paul J. Hirsch
(74) *Attorney, Agent, or Firm*—Dennison, Schultz & Dougherty

(57) ABSTRACT

A throttle gear 5 is fastened to a throttle shaft 2. A relief lever 9 is pivotally mounted on the throttle shaft 2. A return spring 11 urges the relief lever 9 in a valve closing direction with respect to a throttle body 1. The throttle body 1 contacts the relief lever 9 at a second contact position 20A when the relief lever 9 pivots to a predetermined pivot position B in the valve closing direction. A relief spring 10 urges the throttle gear 5 in a valve opening direction with respect to the relief lever 9. The relief lever 9 contacts the throttle gear 5 at a first contact position 20B when the throttle gear 5 pivots to the predetermined pivot position B in the valve opening direction. The first and second contact positions 20B, 20A are located within or to one side of a plane P that is perpendicular to the rotational axis L of the throttle shaft 2. Plane P preferably includes a third position 20C at which the biasing force of the return spring 11 acts on the relief lever 9.

12 Claims, 8 Drawing Sheets

THROTTLES

BACKGROUND OF THE INVENTION

1. Field of the Invention

The present invention relates to throttles for a vehicle engine, such as an internal combustion engine, and more particularly, to throttle valve control devices for controlling a throttle valve disposed within the throttle.

2. Description of the Related Art

A known throttle valve control device is disclosed in Japanese Laid-Open Patent Publication No. 3-271528 and is reproduced in FIGS. 9 to 14. As shown in FIG. 9, a throttle body 101 rotatably supports a throttle shaft 102. A throttle valve (not shown) is attached to throttle shaft 102. As shown in FIG. 11, a throttle gear 105 is mounted on the end of throttle shaft 102. Further, a relief lever 109 is pivotally mounted on throttle shaft 102 between throttle body 101 and throttle gear 105.

A clearance is provided between relief lever 109 and throttle shaft 102 so as to permit relief lever 109 to pivot. Further, clearances are also provided between relief lever 109 and throttle body 101 and between relief lever 109 and throttle gear 105. Therefore, as shown in FIGS. 11 and 13, relief lever 109 may tilt with respect to throttle shaft 102. As shown in FIG. 11, a return spring 111 is disposed around throttle body 101 and one end 111*a* of return spring 111 engages relief lever 109. Return spring 111 urges relief lever 109 in the valve closing direction with respect to throttle body 101. Further, a relief spring 110 is disposed within relief lever 109 and is connected to throttle gear 105. Relief spring 110 urges throttle gear 105 in the valve opening direction with respect to relief lever 109.

As shown in FIG. 9, first contact members (first contact means) 120*b* are provided on throttle gear 105 and relief lever 109. First contact members 120*b* contact each other when throttle gear 105 pivots to a predetermined pivot position in the valve opening direction. Further, second contact members (second contact means) 120*a* are provided on throttle body 101 and relief lever 109. Second contact members 120*a* contact each other when relief lever 109 pivots to a predetermined pivot position in the valve closing direction.

During operation, the position of the throttle valve within throttle body 101 is determined by the amount of torque supplied by a throttle valve controlling motor (not shown) to the throttle shaft 102, which torque acts against return spring 109. On the other hand, when the engine is not operated, the throttle valve control motor does not supply any torque to adjust the position of the throttle valve as shown in FIG. 9. In this state, return spring 111 urges throttle shaft 102 towards an initial or standby open position in which first contact members 120*b* contact each other at contact position 120B and second contact members 120*a* contact each other at contact position 120A. In the initial or standby open position, the throttle valve is slightly opened in order to permit airflow through an intake air passage in the throttle body 101. Thus, even if the throttle valve and/or throttle shaft 102 freezes in a cold environment, or adhesive materials, such as combustion products, deposit in the throttle and cause the throttle valve to be locked or stuck in the initial or standby position, airflow is still supplied to the engine. Therefore, the engine will reliably start even under these conditions.

When the throttle valve rotates in the valve opening direction from the initial or standby open position, first contact members 120*b* will continue contact each other at contact position 120B, as shown in FIG. 10. However, throttle gear 105 and relief lever 109 will pivot about rotational axis L of throttle shaft 102. When the throttle valve rotates from the initial or standby open position in the valve closing direction, second contact members 120*a* prevent rotation of relief lever 109, as shown in FIG. 12. Thus, in this state, only the throttle gear 105 will pivot about rotational axis L.

Additional description concerning Japanese Laid-Open Patent Publication No. 3-271528 can be found, for example, in the background sections of U.S. Pat. Nos. 5,735,243 and 6,164,623.

PROBLEM OF THE RELATED ART

As a result of research performed by the inventors, the known throttle exhibits hysteresis around the initial or standby open position, which is believed to be caused for the following reasons. As shown in FIG. 9, contact position 120B of first contact members 120*b* and contact position 120A of second contact members 120*a* are located in separate positions that are on opposite sides of a plane P that is perpendicular to rotational axis L. Plane P includes position 120C at which the urging force of return spring 111 acts on relief lever 109. Specifically, contact position 120B of first contact members 120*b* is located on one side of plane P, i.e. below plane P as viewed in FIG. 9. Contact position 120A of second contact members 120*a* is located on the other side of plane P, i.e. above plane P as viewed in FIG. 9. As a result, relief lever 109 will tilt or pivot with respect to plane P when relief lever 109 moves from a first position (FIG. 10), in which the first contact members 120*b* contact each other and throttle gear 105 and relief lever 109 pivot, to a second position (FIG. 12), in which second contact members 120*a* prevent further rotation of relief lever 109 and only the throttle gear 105 can pivot.

Specifically, when the throttle valve rotates to the pivot position shown in FIG. 10, first contact members 120*b* contact each other on one side of plane P and relief lever 109 tilts downward to the right. On the other hand, when the throttle valve rotates to the pivot position shown in FIG. 12, second contact members 120*a* contact each other on the other side of plane P and relief lever 109 tilts downward to the left.

FIG. 14 shows a graph that relates the operating torque required by the throttle valve control motor to move the throttle valve to the various pivot positions within the working range of the known throttle described in Japanese Laid-open Patent Publication 3-271528. The abscissa represents the pivot position of the throttle valve (throttle opening position) and the ordinate represents the operating torque required by the throttle valve control motor to move the throttle valve to the respective pivot positions. As shown by FIG. 14, the operating torque is zero at the initial or standby open position B. Moreover, in the known throttle, the operating torque is also zero in a range between valve position A and valve position C, which is hysteresis with respect to the initial or standby open position. If the throttle exhibits a relatively large hysteresis, the initial or standby open position will vary during operation and thus, the amount of airflow into the throttle in the initial or standby mode will vary. However, the amount of airflow should be precisely controlled in the initial or standby open position. Thus, the known throttle exhibits a disadvantage, which is believed to be caused by the fact that the relief lever 109 pivots with respect to plane P when the throttle valve moves to the initial or standby open position B.

SUMMARY OF THE INVENTION

It is, accordingly, one object of the present teachings to provide improved throttles and more particularly, devices for controlling the position of a throttle valve disposed within the throttle.

In one aspect of the present teachings, a relief lever is preferably prevented from tilting with respect to plane P during operation, which plane P is perpendicular, or substantially perpendicular, to the rotational axis L of a throttle shaft. Therefore, the position of the throttle valve can be controlled more precisely.

In one embodiment of the present teachings, first contact members are provided on the throttle gear and the relief lever and second contact members are provided on the throttle body and the relief lever. Both the first contact members and the second contact members have contact positions that are located in plane P. In the alternative, both the first contact members and the second contact members have contact positions that are located on the same side with respect to plane P. In addition, plane P preferably includes a position in which the biasing force of a return spring acts on the relief lever. In either embodiment, the relief lever is preferably prevented from tilting with respect to plane P during operation.

Additional objects, features and advantages of the present invention will be readily understood after reading the following detailed description together with the accompanying drawings and the claims.

DETAILED DESCRIPTION OF THE INVENTION

Figure 1:
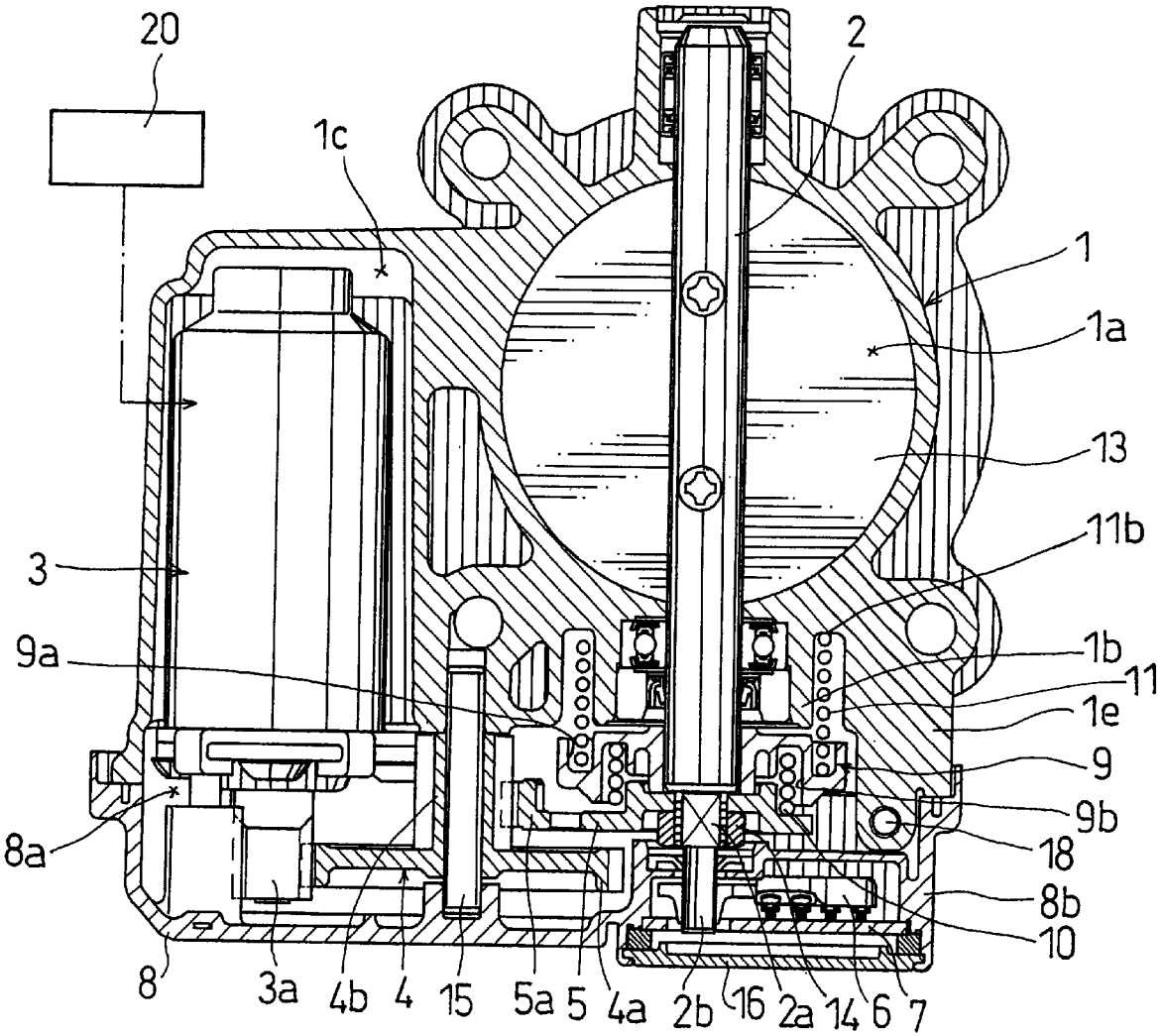
FIG. 1 is a sectional plan view of a first embodiment of the present teachings.

Representative throttles may include, for example, a throttle body having an air intake passage. A throttle shaft may be rotatably supported by the throttle body and have a rotational axis. A throttle valve may be disposed on the throttle shaft and is preferably adapted to open and close the intake air passage. A relief lever can be pivotally mounted on the throttle shaft and a return spring can be disposed between the throttle body and the relief lever. The return spring is preferably adapted to urge the relief lever in a valve closing direction with respect to the throttle body. A throttle gear may be fastened to the throttle shaft.

Optionally, a relief spring may be disposed between the throttle gear and the relief lever. The relief spring may be adapted to urge the throttle gear in a valve opening direction with respect to the relief lever.

In one embodiment, the throttle may have a first contact position at which the throttle gear and the relief lever contact each other when the throttle gear pivots to a predetermined pivot position in the valve opening direction. The throttle may also have a second contact position at which the throttle body and the relief lever contact each other when the relief lever pivots to the predetermined pivot position in the valve closing direction. In one embodiment, the first contact position and the second contact position may be both located within a plane P that is perpendicular to the rotational axis L of the throttle shaft. Plane P preferably includes a position in which the biasing force of the return spring acts on the relief lever. In an alternative embodiment, the first and second contact position may be located on the same side of plane P, but not within plane P.

In a further preferred embodiment, the throttle gear may include a pin. Moreover, the relief lever may include a projection. The pin may contact the projection at the first contact position. Further, an adjustment screw may be provided that threadably engages the throttle body. The adjustment screw preferably contacts the projection at the second contact position. The pin, projection and adjustment screw are preferably disposed either within plane P or on the same side of plane P.

In another embodiment, first contact means may be provided in the throttle gear and the relief lever. The first contact means is preferably adapted to contact when the throttle gear pivots to a predetermined pivot position in the valve opening direction. Second contact means also may be provided in the throttle body and the relief lever. The second contact means may be adapted to contact when the relief lever pivots to the predetermined pivot position in the valve closing direction. In a further embodiment, a first contact position of the first contact means and a second contact position of the second contact means may be both located either (i) within a plane P that is perpendicular to the rotational axis of the throttle shaft or (ii) on the same side of the plane P. Preferably, plane P includes a position in which the biasing force of the return spring acts on the relief lever.

In one or more of the embodiments, the position of the relief lever is preferably prevented from tilting as a result of the relief lever moving to the predetermined pivot position B from (i) the valve closing direction or (ii) the valve opening direction.

Also in one or more the above embodiments, a control motor may be provided to supply torque to a gear mechanism disposed between the control motor and the throttle gear. The gear mechanism preferably transmits torque from the control motor to the throttle shaft.

If the contact position of the first contact means and the contact position of the second contact means are located on opposite sides of a plane P that is perpendicular to an axis of the throttle shaft, as the case in the known throttle described above, the tilting state of the relief lever will change with changes in the operating state of the relief lever. On the other hand, if the contact position of first contact means and the contact position of second contact means are located within plane P that is perpendicular to the rotational axis L of the throttle shaft, or on the same side of plane P, and plane P preferably includes a position where the biasing force of the return spring acts on the relief lever, the relief lever will not tilt as a result of the operating state of the relief lever.

Representative examples of the present invention will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

First Representative Embodiment

A first representative embodiment will now be explained with reference to FIGS. 1 to 5. As shown in FIG. 1, a generally cylindrical intake air passage 1*a* is defined within a throttle body 1. Intake air passage 1*a* preferably communicates with an induction system of the engine (not shown). Throttle body 1 rotatably supports a throttle shaft 2 and a throttle valve 13 is attached to throttle shaft 2. In this embodiment, in order to increase the opening area of intake air passage 1*a*, which will increase the airflow to the engine, throttle shaft 2 is rotated in the clockwise direction as viewed in FIG. 2. On the other hand, in order to decrease the opening area of intake air passage 1*a*, which will decrease the airflow to the engine, throttle shaft 2 is rotated in the counterclockwise direction as viewed in FIG. 2. Thus, the amount of intake air that is supplied to the engine through intake air passage 1*a* can be adjusted by changing the pivot position of throttle valve 13, which will change the opening area of intake air passage 1*a*.

A gear housing 1*e* is disposed on one peripheral side of throttle body 1, as shown in the lower right portion of FIG. 1. A gear cover 8 is mounted on the surface of the open end of gear housing portion 1*e*. A housing space 8*a* is defined within gear cover 8. A driving gear 3*a*, a counter gear 4, a throttle gear 5 and a relief lever 9 are disposed within housing space 8*a*.

Figure 2:
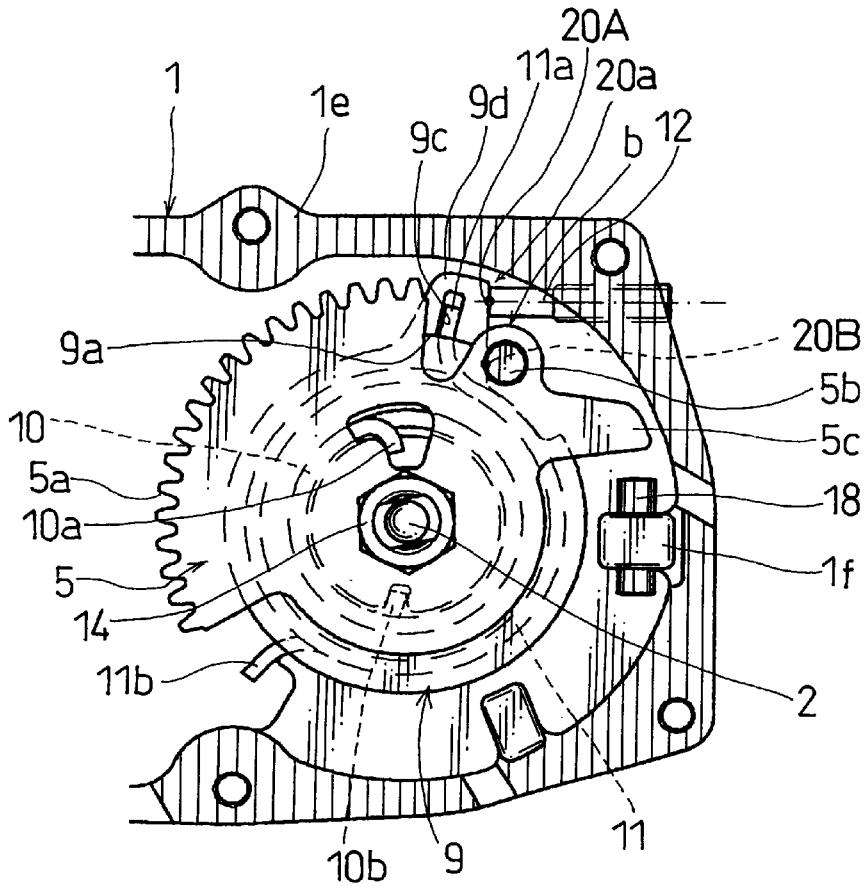
FIG. 2 is a partial front view of FIG. 1, in which a throttle valve is positioned in an initial or standby open position.

A boss 1*b* is defined within throttle body 1. One end of throttle shaft 2 projects through boss 1*b* into housing space 8*a*. An engagement shank 2*a* and a small-diameter shank 2*b* are defined on the portion of throttle shaft 2 that projects into housing space 8*a*. Engagement shank 2*a* may have a generally rectangular cross-section and small-diameter shank 2*b* preferably extends through gear cover 8. Further, throttle gear 5 is fastened to engagement shank 2*a* of throttle shaft 2 by a nut 14. As shown in FIG. 2, throttle gear 5 may have a fan shape and preferably includes a gear or toothed portion 5*a* disposed along a portion of the outer periphery of throttle gear 5.

Referring to the left side of FIG. 1, a motor housing recess 1*c* also is defined within throttle body 1 and includes an opening that communicates with housing space 8*a*. A throttle valve control motor 3, which may be for example a DC step motor, is disposed within motor housing space 8*a*. Driving gear 3*a* is secured to an output shaft of control motor 3 and also is disposed within housing space 8*a*.

A counter shaft 15 is disposed between throttle body 1 and gear cover 8. Counter shaft 15 is preferably located in a generally medial position between throttle shaft 2 and the output shaft of control motor 3. Counter gear 4 is mounted on counter shaft 15 and rotates together with counter shaft 15. Counter gear 4 has a large-diameter gear portion 4*a* disposed on the side of gear cover 8 and a small-diameter gear portion 4*b* disposed on the side of throttle body 1. Large-diameter gear portion 4*a* engages driving gear 3*a* and small-diameter gear portion 4*b* engages gear portion 5*a*.

A controller 20 may receive input signals from various sensors (not shown) and may output control signals to operate throttle valve control motor 3. Controller 20 is preferably a processor and may be part of an engine control unit (ECU). The input signals may include, for example, signals indicating the amount of depression of the accelerator pedal, signals indicating the engine coolant temperature, engine speed, signals from an automatic transmission and/or other signals representing the operating state of the engine. The driving force (torque) of control motor 3 is transmitted to throttle shaft 2 via driving gear 3*a*, counter gear 4 and throttle gear 5. As a result, throttle valve 13 pivots in order to adjust the amount of air flowing through intake air passage 1*a*. Preferably, controller 20 is programmed to execute one or more control functions, such as traction control, idle speed control and/or constant speed running control. Representative techniques for programming and operating controller 20 are taught in further detail in U.S. Pat. Nos. 5,906,185 and 6,116,214.

A generally disc-shaped relief lever 9 is mounted on throttle shaft 2. Relief lever 9 is disposed between boss 1*b* and throttle gear 5. A predetermined clearance is provided between relief lever 9 and throttle shaft 2 so as to permit relief lever 9 to pivot with respect to throttle shaft 2. Further, a predetermined clearance is also provided between the throttle body 1 and throttle gear 5, which are disposed on opposite sides of relief lever 9. Therefore, relief lever 9 may tilt with respect to throttle shaft 2.

A large-diameter annular groove 9*a* is defined within the surface of relief lever 9 that faces throttle body 1. A small-diameter annular groove 9*b* is defined within the surface of relief lever 9 that faces throttle gear 5. A return spring 11, which is preferably a coil spring, is disposed between throttle body 1 and relief lever 9. One end 11*b* of return spring 11 is disposed around boss 1*b* and engages throttle body 1. As shown in FIG. 2, the other end 11*a* of return spring 11 is disposed within large-diameter annular groove 9*a* of relief lever 9 and engages an engagement recess 9*c* that is formed within large-diameter annular groove 9*a* of relief lever 9. Return spring 11 urges relief lever 9 in the valve closing direction with respect to throttle body 1, i.e. in the clockwise direction as viewed in FIG. 2.

A relief spring 10, which is also preferably a coil spring, is disposed between throttle gear 5 and relief lever 9. Relief spring 10 is disposed within small-diameter annular groove 9*b* of relief lever 9. As shown in FIG. 2, one end 10*a* of relief spring 10 engages throttle gear 5 and the other end 10*b* engages relief lever 9. Relief spring 10 urges throttle gear 5 in the valve opening direction with respect to relief lever 9, i.e. in the counterclockwise direction as viewed in FIG. 2.

The biasing forces of return spring 11 and relief spring 10 are preferably less than the driving torque of control motor 3 and are greater than the stalling torque of control motor 3. In this embodiment, the biasing force of relief spring 10 is preferably less than the biasing force of return spring 11.

As shown in FIGS. 1 and 2, first contact means 20*b* is provided and operates when throttle gear 5 pivots in the valve opening direction from the valve closing position to a predetermined pivot position, which preferably corresponds to the initial or standby open position B of throttle valve 13. In this embodiment, first contact means 20*b* comprises a pin 5*b* and a projection 9*d*. Pin 5*b* projects from the end surface of throttle gear 5 on the side of relief lever 9. Projection 9*d* extends outward from the outer periphery of relief lever 9. Engagement recess 9*c* is defined within projection 9*d*. According to the present teachings, members that form first contact means 20*b* (e.g., pin 5*b* and projection 9*d* in this embodiment) will be referred to as first contact members.

In addition, second contact means 20*a* is provided and operates when relief lever 9 pivots in the valve closing direction from the valve opening position to a predetermined pivot position, which again preferably corresponds to the initial or standby open position B of throttle valve 13. In this embodiment, second contact means 20*a* comprises an adjustment screw 12, which threadably engages gear housing portion 1*e* of throttle body 1, and projection 9*d*, which extends from the outer periphery of relief lever 9. As shown in FIG. 2, contact position 20A of adjustment screw 12 and the position of projection 9*d* of relief lever 9 can be adjusted by advancing or retreating adjustment screw 12. According to the present teachings, members that form second contact means 20*a* (e.g., adjustment screw 12 and projection 9*d* in this embodiment) will be referred to as second contact members.

Figure 3:
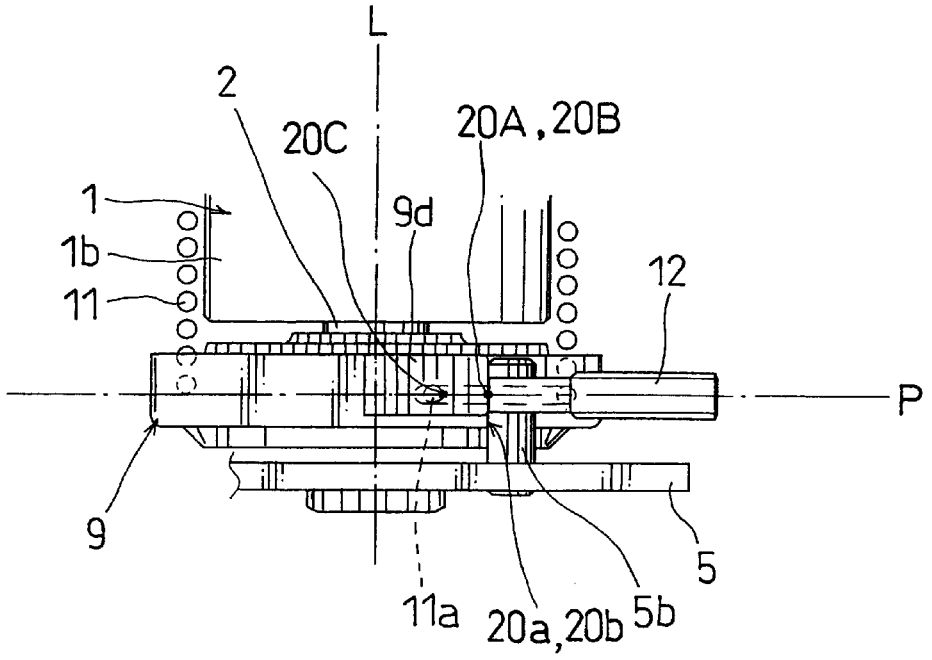
FIG. 3 is a partial plan view of FIG. 2, in which the throttle valve is positioned in the initial or standby open position.

In this embodiment as shown in FIG. 3, contact position 20B of first contact members 5*b*, 9*d* and contact position 20A of second contact members 12, 9*d* are located within a plane P that is perpendicular to the rotational axis L of throttle shaft 2. Plane P also includes a position 20C in which the biasing force of return spring 11 acts on relief lever 9, i.e. the position at which end 10*a* of relief spring 10 engages relief lever 9.

Figure 5:
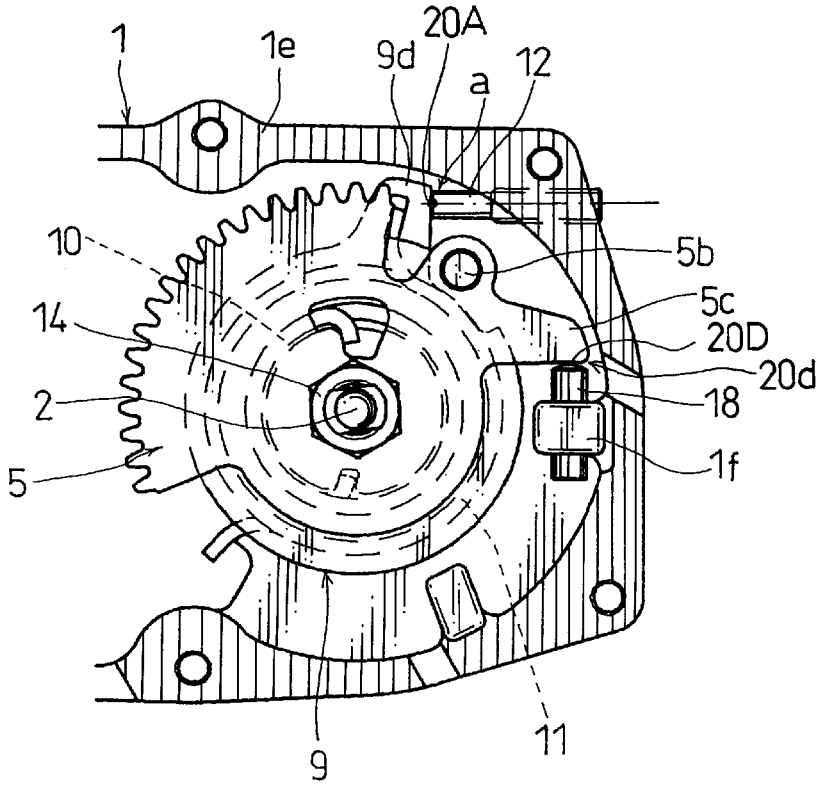
FIG. 5 is a partial front view of FIG. 1, in which the throttle valve is rotated in a valve closing direction from the initial or standby open position.

Further, as shown in FIG. 5, a third contact means 20*d* is provided and operates when throttle gear 5 pivots in the valve closing direction to a predetermined pivot position, which again may correspond to the initial or standby open position B of throttle valve 13. In this embodiment, third contact means 20*d* comprises a minimum opening adjustment screw 18, which threadably engages a projection 1*f* of throttle body 1, and a projection 5*c* that extends from throttle gear 5. As shown in FIG. 5, contact position 20D, in which minimum opening adjustment screw 18 and projection 5*c* of throttle gear 5 contact each other, can be adjusted by advancing or retreating minimum opening adjustment screw 18. According to the present teachings, members that form third contact means 20*d* (e.g., minimum opening adjustment screw 18 and projection 5*c* in this embodiment) will be referred to as third contact members.

As shown in the right side portion of FIG. 1, a sensor housing 8*b* is disposed on gear cover 8. A sensor substrate 7 is disposed in an opening of sensor housing 8*b*. A sensor cover 16 encloses an open end surface of sensor housing portion 8*b*. Small-diameter shank 2*b* of throttle shaft 2 extends through gear cover 8 into the opening of sensor housing 8*b*. A sensor lever 6 is fastened to small-diameter shank 2*b*. Sensor lever 6 and sensor substrate 7 form a throttle position sensor for detecting the opening (pivot position) of throttle valve 13. Representative techniques for constructing and operating the throttle position sensor are taught in further detail in U.S. Pat. Nos. 5,571,960 and 6,070,458.

A representative method for operating the throttle of the first representative embodiment will now be explained. For example, control motor 3 preferably is not energized when the engine is not operating. Therefore, second contact means 20*a* operates in this state. Specifically, as shown in FIGS. 2 and 3, projection 9*d* of relief lever 9 contacts adjustment screw 12 of throttle body 1 at contact position 20A due to the biasing force of return spring 11. In addition, first contact means 20*b* also operates in this state. Specifically, pin 5*b* of throttle gear 5 contacts projection 9*d* of relief lever 9 at contact position 20B due to the biasing force of relief spring 10. As a result, throttle valve 13 is held in the initial or standby open position B that has been set using adjustment screw 12.

As discussed above, the initial or standby open position B is chosen to be a position in which throttle valve 13 slightly opens intake air passage 1*a*. Therefore, throttle valve 13 and throttle shaft 2 are prevented from freezing in cold regions. Further, throttle valve 13 is prevented from being locked or stuck in the valve closed position due to the deposition of combustion products or similar materials. Thus, the engine will reliably start, even if these conditions are present.

When the engine starts, controller 20 supplies drive signals to control motor 3 and control motor 3 will adjust the pivot position (opening) of throttle valve 13. By changing the pivot position of throttle valve 13, the amount of air flowing through intake air passage la can be adjusted.

For example, when the accelerator pedal is not depressed and the engine is in an idling state, the pivot position of throttle valve 13 is moved to an idling position. That is, the throttle valve 13 moves from the initial or standby open position B toward the valve closing direction. In this case, as shown in FIG. 5, projection 9*d* of relief lever 9 contacts adjustment screw 12 of throttle body 1 so that relief lever 9 is prevented from further rotating. As a result, only the throttle gear 5 will pivot in the valve closing direction against the biasing force of relief spring 10. The pivotal movement of throttle gear 5 in the valve closing direction stops at contact position 20D, because projection 5*c* of throttle gear 5 contacts minimum opening adjustment screw 18 of throttle body 1. By adjusting the position of minimum opening adjustment screw 18, the position (i.e. the idling position) where throttle valve 13 stops pivoting in the valve closing direction is determined. When the pivot position of throttle valve 13 is set to the idling position, the amount of intake air is adjusted in accordance with the idling speed.

When the accelerator pedal is depressed, controller 20 supplies drive signals to control motor 3 and the drive signals are based, in part, upon the amount of depression of the accelerator pedal. The pivot position of throttle valve 13 is adjusted in accordance with the drive signals.

Figure 4:
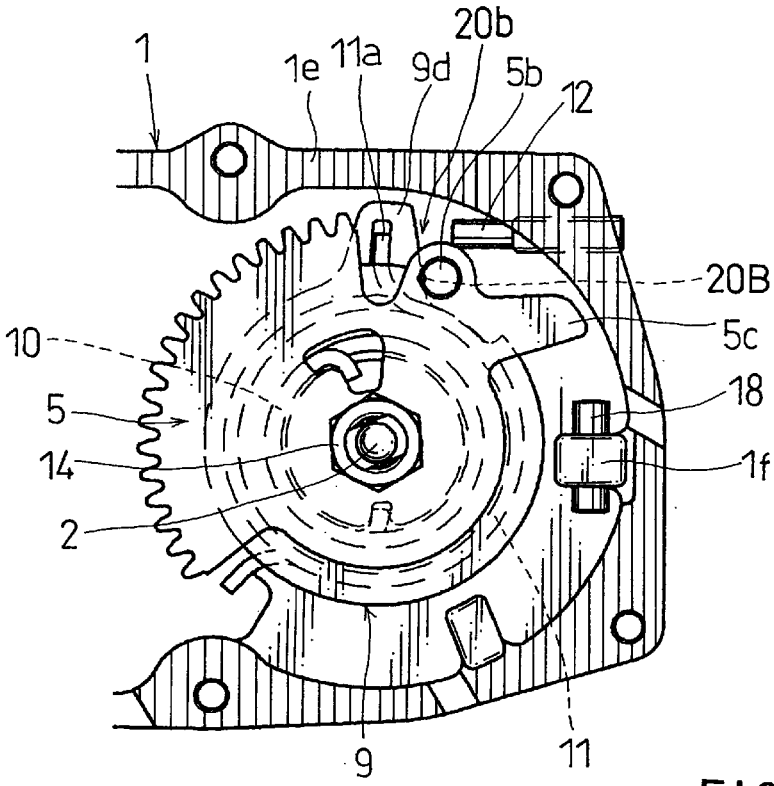
FIG. 4 is a partial front view of FIG. 1, in which the throttle valve is rotated in a valve opening direction from the initial or standby open position.

When the pivot position of throttle valve 13 is rotated toward the valve closing direction from the initial or standby open position, projection 9*d* of relief lever 9 contacts adjustment screw 12 of throttle body 1 and relief lever 9 is prevented from further rotating. In this state, only the throttle gear 5 pivots against the biasing force of relief spring 10. On the other hand, when the pivot position of throttle valve 13 is rotated toward the valve opening direction from the initial or standby open position B, as shown in FIG. 4, pin 5*b* of throttle gear 5 contacts projection 9*d* of relief lever 9. In this state, throttle gear 5 and relief lever 9 pivot together against the biasing force of return spring 11.

As shown in FIGS. 2 and 3, when the engine stops and thus control motor 3 stops supplying torque to throttle valve 13, the pivot position of throttle valve 13 returns to the initial or standby open position B. For example, as shown in FIG. 4, the control motor 3 may stop in the state that the pivot position of throttle valve 13 has been rotated in the valve opening direction from the initial or standby open position B. In this case, throttle gear 5 and relief lever 9 pivot toward the valve closing direction due to the biasing force of return spring 11. Projection 9*d* of relief lever 9 is then held in contact with adjustment screw 12 of throttle body 1. Thus, the pivot position of throttle valve 13 is held in the initial or standby open position. On the other hand, as shown in FIG. 5, the control motor 3 may stop in the state in which the pivot position of throttle valve 13 has been rotated toward the valve closing direction from the initial or standby open position B. In this case, throttle gear 5 pivots toward the valve opening direction due to the biasing force of relief spring 10. Pin 5*b* of throttle gear 5 is then held in contact with projection 9*d* of relief lever 9. Thus, the pivot position of throttle valve 13 is held in the initial or standby open position B.

In this embodiment, as shown in FIG. 3, contact position 20B of first contact means 20*b* and contact position 20A of second contact means 20*a* are located within plane P and plane P is perpendicular to the rotational axis L of throttle shaft 2. Further, position 20C in which the biasing force of return spring 11 acts on relief lever 9 is also located within plane P. Therefore, relief lever 9 is reliably prevented from tilting out of plane P in both operating conditions. That is, relief lever 9 will not tilt if first contact means 20*b* pivots throttle gear 5 and relief lever 9 or if second contact means 20*a* prevents rotation of relief lever 9. Therefore, the position of relief lever 9 can be prevented from tilting out of plane P as a result of a change in the operating state of relief lever 9.

Figure 6:
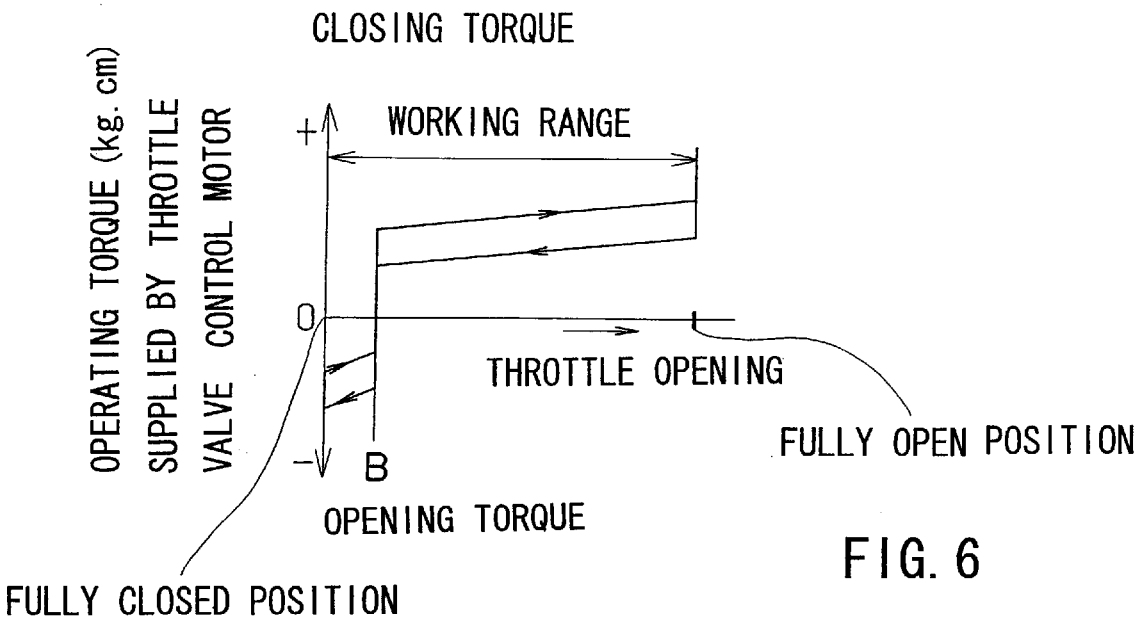
FIG. 6 is a graph showing the operating torque characteristics of the first embodiment.
Figure 14:
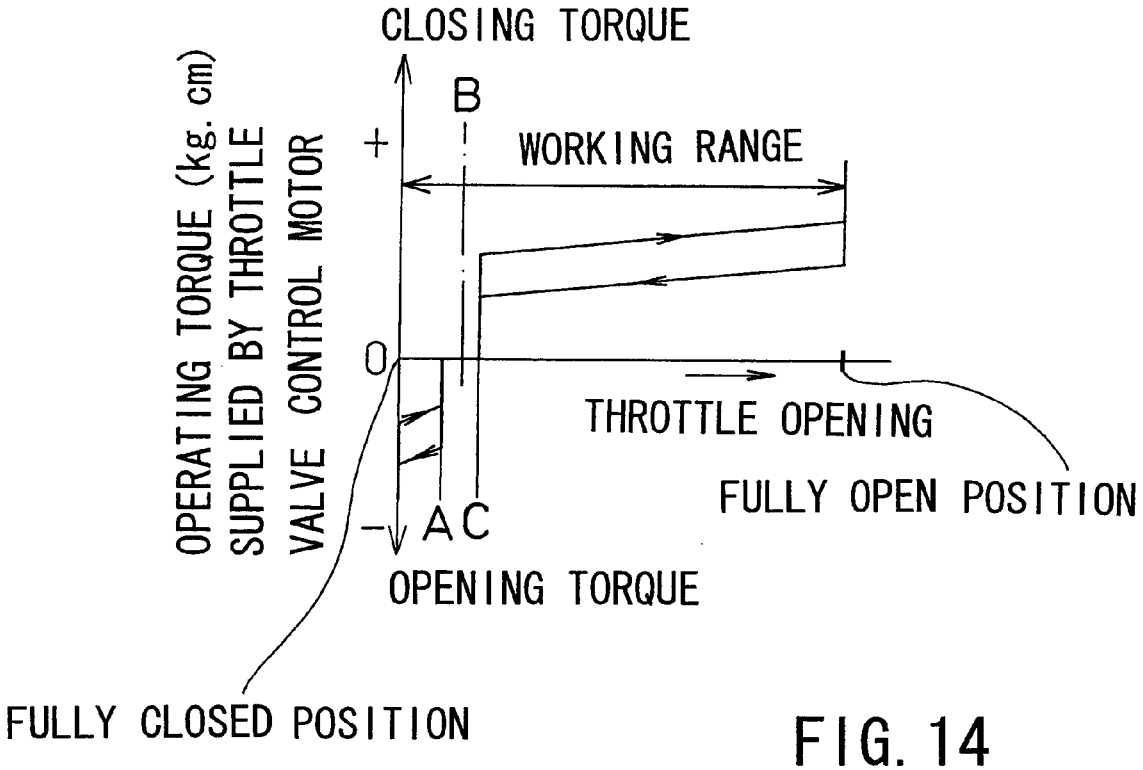
FIG. 14 is a graph showing the operating torque characteristics of the known throttle.

FIG. 6 is a graph showing the operating torque supplied by control motor 3 to adjust the position of throttle valve 13 in this representative embodiment. The abscissa represents the pivot position of throttle valve 13 (throttle opening) and the ordinate represents the operating torque applied to throttle valve 13. As discussed above with respect to the known throttle, hysteresis at the initial or standby position B may be caused by changes in the tilting position of relief lever 9 with respect to plane P. This hysteresis is evident in FIG. 14. On the other hand, as shown in FIG. 6, hysteresis at the initial or standby position B can be eliminated according to the present teachings. Therefore, the initial or standby valve position B of throttle valve 13 can be reliably determined according to the present teachings and the amount of intake air supplied to the engine also can be reliably controlled in the initial or standby valve position B. Consequently, the positional accuracy of throttle valve 13 can be improved by preventing relief lever 9 from tilting as a result of a change in the operating state of relief lever 9.

Further, by preventing changes in the tilting position of relief lever 9, it is possible to minimize the frictional force that is generated between relief lever 9 and parts adjacent to relief lever 9 (e.g. boss 1*b* of throttle body 1 and throttle gear 5) when relief lever 9 rotates.

Second Representative Embodiment

A second representative embodiment will now be explained with reference to FIG. 7, which is a modification of the first representative embodiment. Therefore, only changed or modified portions of the first representative embodiment will be discussed and overlapping description will be omitted.

Figure 7:
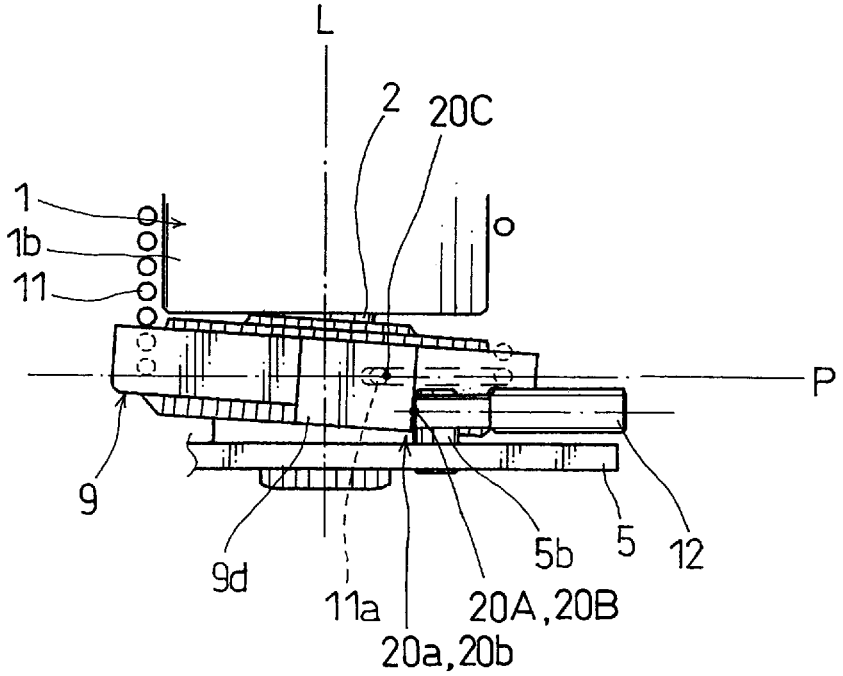
FIG. 7 is a plan view of a relevant portion of a second embodiment of the present teachings.

As shown in FIG. 7, the second representative embodiment also includes contact position 20B of first contact means 20*b* and contact position 20A of second contact means 20*a*. However, in the second representative embodiment, contact position 20B and contact position 20A are located to one side of plane P that is perpendicular to the rotational axis L of throttle shaft 2. In this embodiment, contact positions 20A and 20B are located below plane P as shown in FIG. 7. Similar to the first representative embodiment, position 20C, in which the biasing force of return spring 11 acts on relief lever 9, is located in plane P.

Thus, the second representative embodiment also provides both operating states in which first contact means 20*b* pivots throttle gear 5 and relief lever 9 and in which second contact means 20*a* prevents rotation of relief lever 9. In both operating states, relief lever 9 is held tilted in the same direction. Specifically, as shown in FIG. 7, relief lever 9 is held tilted downward to the right in both of the operating states. Therefore, the tilting position of relief lever 9 can be prevented from changing as a result of changes in the operating state of relief lever 9. Thus, the pivot position of throttle valve 13 can be more accurately controlled.

Third Representative Embodiment

A third representative embodiment will now be explained with reference to FIG. 8, which is also a modification of the first representative embodiment. Therefore, only changed or modified portions with respect to the first representative embodiment will be discussed and overlapping description will be omitted.

Figure 8:
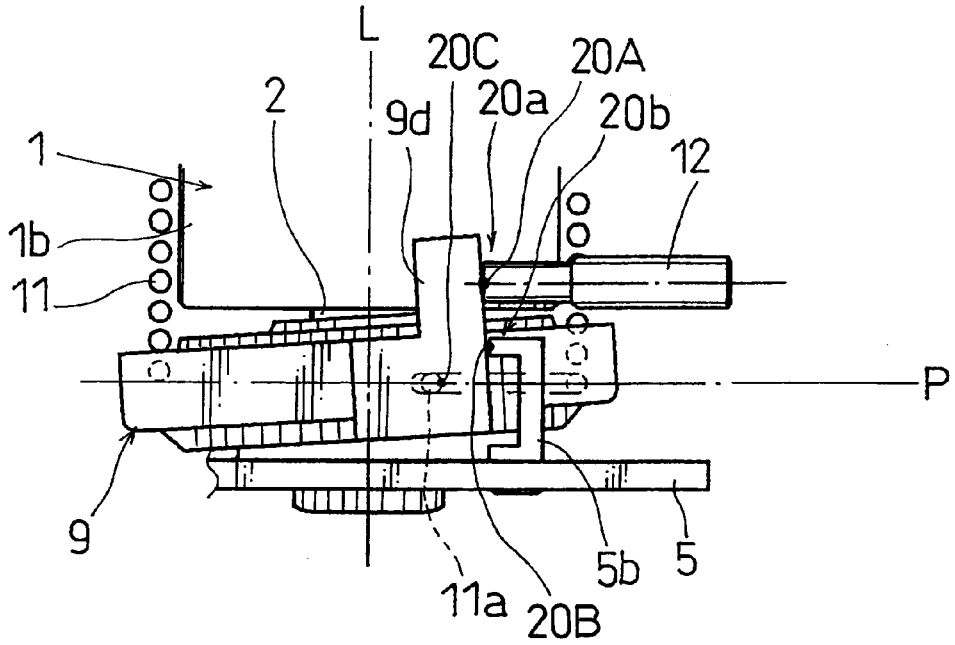
FIG. 8 is a plan view of a relevant portion of a third embodiment of the present teachings.
Figure 9:
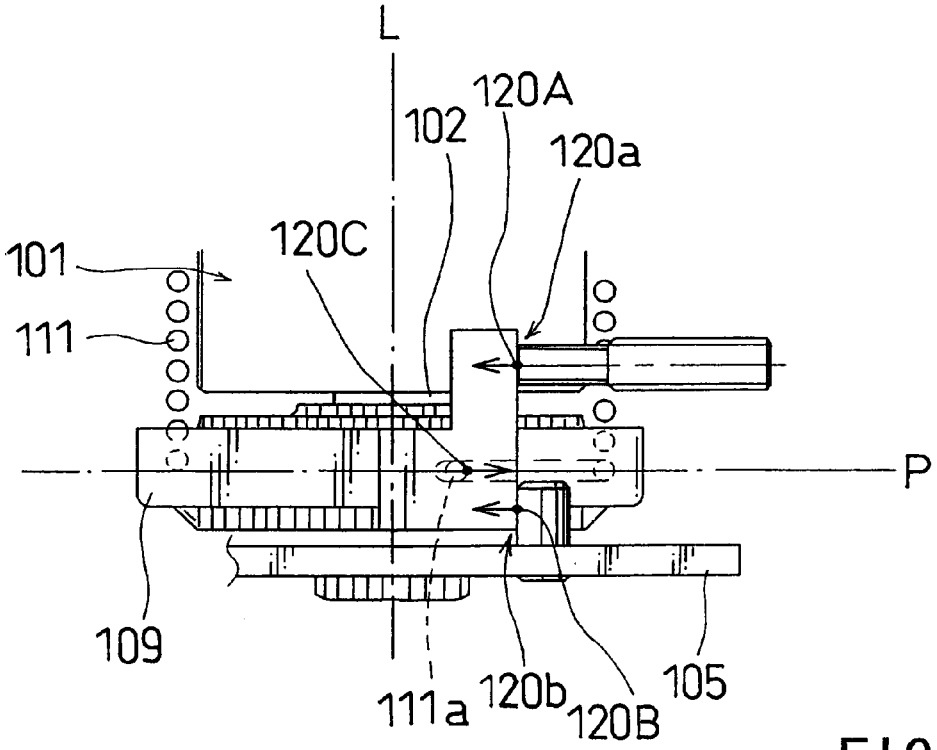
FIG. 9 PRIOR ART
FIG. 9 is a partial plan view of a known throttle.
Figure 10:
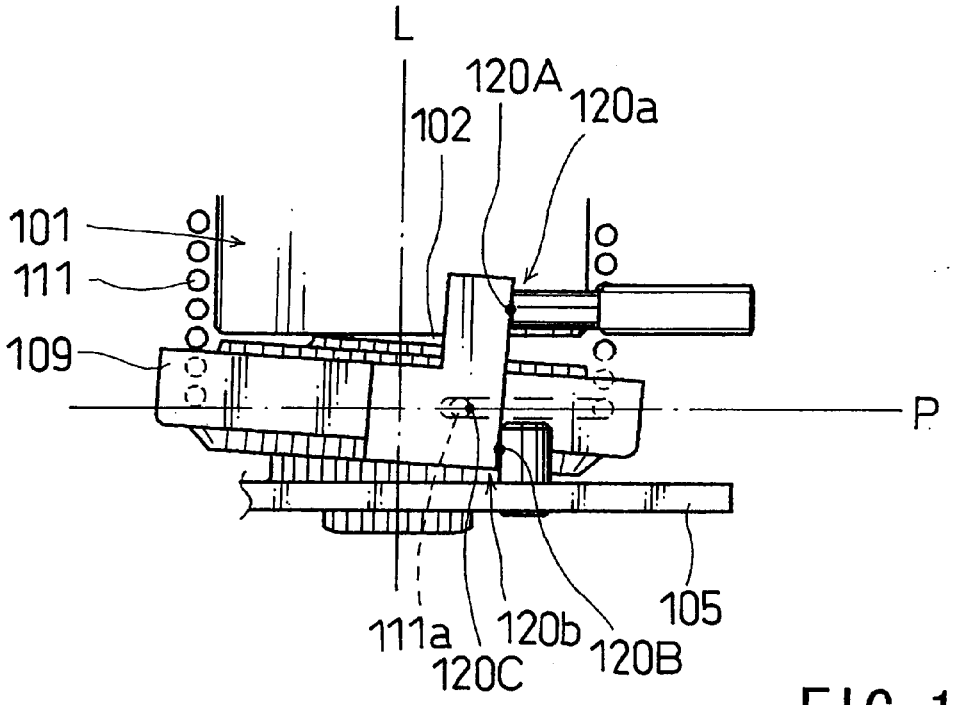
FIG. 10 PRIOR ART
FIG. 10 is a partial plan view of FIG. 9, in which a throttle valve is rotated in a valve opening direction from an initial or standby open position.
Figure 11:
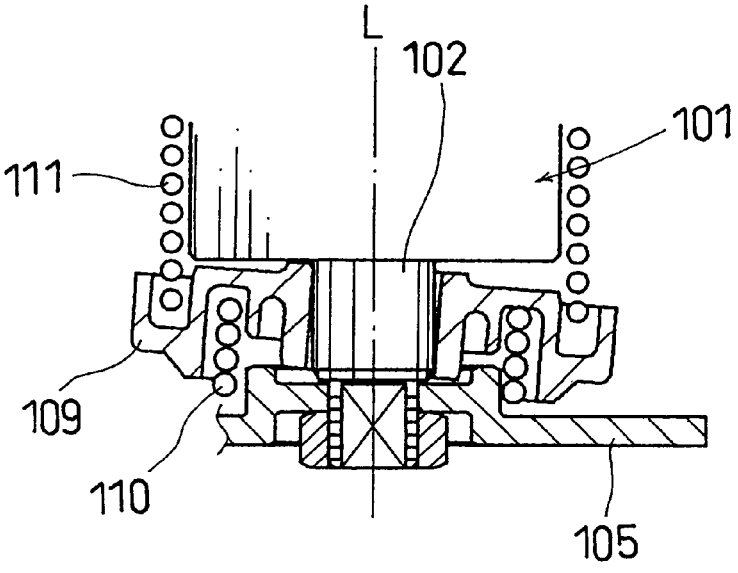
FIG. 11 PRIOR ART
FIG. 11 is a sectional plan view of FIG. 10.
Figure 12:
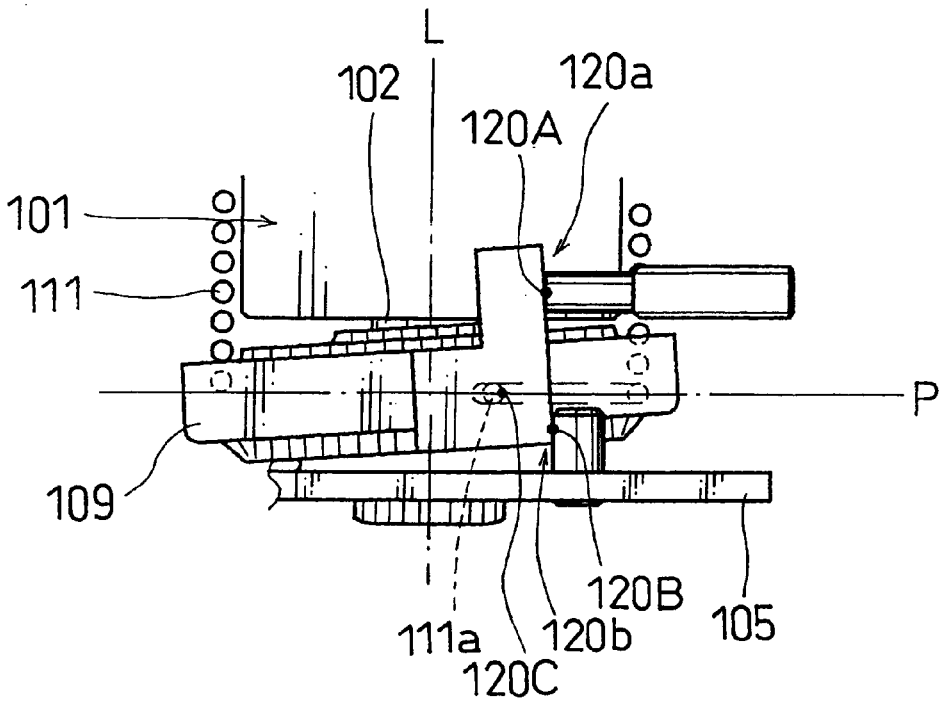
FIG. 12 PRIOR ART
FIG. 12 is a partial plan view of FIG. 9, in which the throttle valve is rotated in a valve closing direction from the initial or standby open position.
Figure 13:
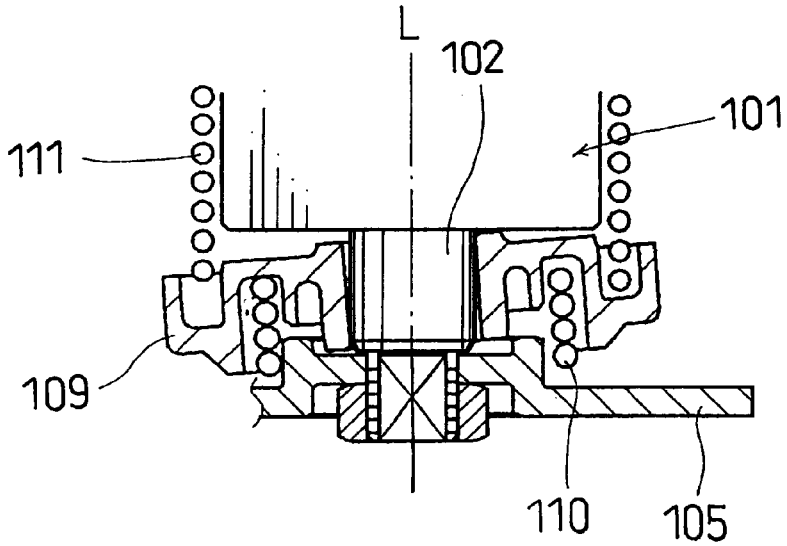
FIG. 13 PRIOR ART
FIG. 13 is a sectional plan view of FIG. 12.

As shown in FIG. 8, contact position 20B of first contact means 20*b* and contact position 20A of second contact means 20*a* are located on the other side of plane P that is perpendicular to the rotational axis L of throttle shaft 2, as compared to the second representative embodiment. Again, position 20C in which the biasing force of return spring 11 acts on relief lever 9 is located within plane P.

Thus, the third representative embodiment provides both operating states in which first contact means 20*b* pivots throttle gear 5 and relief lever 9 and in which second contact means 20*a* prevents rotation of relief lever 9. In both operating states, relief lever 9 is held tilted in the same direction. Specifically, as shown in FIG. 8, relief lever 9 is held tilted downward to the left in both of the operating states. Therefore, the tilting state of relief lever 9 can be prevented from changing due to changes in the operating state of relief lever 9. Thus, the pivot position of throttle valve 13 can be more accurately controlled in this third representative embodiment as well.

The present invention is not limited to the constructions that have been described as the representative embodiments, but rather, may be added to, changed, replaced with alternatives or otherwise modified without departing from the spirit and scope of the invention. For example, instead of throttle gear 5, a lever may be utilized that does not have a gear portion 5*a*. In addition, further techniques for constructing and operating throttles are taught in U.S. Pat. Nos. 5,571,960, 5,735,243, 5,906,185, 6,070,458, 6,116,214, 6,153,952 and 6,164,623. These teachings may be utilized with the present teachings in order to achieve additional embodiments of the present teachings and all these U.S. patents are hereby incorporated by reference as if fully set forth herein.

What is claimed is:

1. A throttle comprising:

a throttle body having an air intake passage, a throttle shaft rotatably supported by the throttle body and having a rotational axis L, a throttle valve disposed on the throttle shaft and adapted to open and close the intake air passage, a relief lever pivotally mounted on the throttle shaft, a return spring disposed between the throttle body and the relief lever and adapted to urge the relief lever in a valve closing direction with respect to the throttle body, a throttle gear fastened to the throttle shaft and a relief spring disposed between the throttle gear and the relief lever and adapted to urge the throttle gear in a valve opening direction with respect to the relief lever, wherein a first contact position is defined at a point in which the throttle gear contacts the relief lever when the throttle gear pivots to a predetermined pivot position B in the valve opening direction, wherein a second contact position is defined at a point in which the throttle body contacts the relief lever when the relief lever pivots to the predetermined pivot position B in the valve closing direction, wherein the first contact position and the second contact position are both located either (i) within a plane P that is perpendicular to the rotational axis L of the throttle shaft or (ii) on the same side of the plane P, and wherein the plane P includes a position in which the biasing force of the return spring acts on the relief lever.

2. A throttle as in claim 1, wherein the throttle gear further comprises a pin and the relief lever further comprises a projection and wherein the pin contacts the projection at the first contact position.

3. A throttle as in claim 2, further comprising an adjustment screw that threadably engages the throttle body, wherein the adjustment screw contacts the projection at the second contact position.

4. A throttle as in claim 3, wherein the position of the relief lever is prevented from tilting as a result of the relief lever moving to the predetermined pivot position B from (i) the valve closing direction or (ii) the valve opening direction.

5. A throttle as in claim 4, further comprising a control motor and a gear mechanism disposed between the control motor and the throttle gear, wherein the gear mechanism transmits torque from the control motor to the throttle shaft.

6. A throttle as in claim 1, wherein the position of the relief lever is prevented from tilting as a result of the relief lever moving to the predetermined pivot position B from (i) the valve closing direction or (ii) the valve opening direction.

7. A throttle as in claim 1, further comprising a control motor and a gear mechanism disposed between the control motor and the throttle gear, wherein the gear mechanism transmits torque from the control motor to the throttle shaft.

8. A throttle comprising:

a throttle body having an air intake passage, a throttle shaft rotatably supported by the throttle body and having a rotational axis L, a throttle valve disposed on the throttle shaft and adapted to open and close the intake air passage, a relief lever pivotally mounted on the throttle shaft, a return spring disposed between the throttle body and the relief lever and adapted to urge the relief lever in a valve closing direction with respect to the throttle body, a throttle gear fastened to the throttle shaft, a relief spring disposed between the throttle gear and the relief lever and adapted to urge the throttle gear in a valve opening direction with respect to the relief lever, first contact means provided on the throttle gear and the relief lever, wherein the throttle gear contacts the relief lever when the throttle gear pivots to a predetermined pivot position B in the valve opening direction and second contact means provided on the throttle body and the relief lever, wherein the throttle body contacts the relief lever when the relief lever pivots to the predetermined pivot position B in the valve closing direction, wherein a first contact position of the first contact means and a second contact position of the second contact means are both located either (i) within a plane P that is perpendicular to the rotational axis L of the throttle shaft or (ii) on the same side of the plane P, and wherein the plane P includes a position in which the biasing force of the return spring acts on the relief lever.

9. A throttle as in claim 8, wherein the position of the relief lever is prevented from tilting as a result of the relief lever moving to the predetermined pivot position B from (i) the valve closing direction or (ii) the valve opening direction.

10. A throttle as in claim 9, further comprising a control motor and a gear mechanism disposed between the control motor and the throttle gear, wherein the gear mechanism transmits torque from the control motor to the throttle shaft.

11. A throttle as in claim 8, further comprising a control motor and a gear mechanism disposed between the control motor and the throttle gear, wherein the gear mechanism transmits torque from the control motor to the throttle shaft.

12. A throttle comprising:

a throttle body 1 having an air intake passage 1*a*, a throttle shaft 2 rotatably supported by the throttle body 1 and having a rotational axis L, a throttle valve 13 disposed on the throttle shaft 2, the throttle valve 13 opening and closing the intake air passage 1*a* based upon rotation of the throttle shaft 2, a relief lever 9 pivotally mounted on the throttle shaft 2, the relief lever 9 comprising a projection 9*d*, a return spring 11 urging the relief lever 9 in a valve closing direction with respect to the throttle body 1, a throttle gear 5 fastened to the throttle shaft 2, the throttle gear comprising a pin 5*b*, a relief spring 10 urging the throttle gear 5 in a valve opening direction with respect to the relief lever 9, an adjustment screw 12 threadably engaging the throttle body 1, a control motor 3 and a gear mechanism (3*a*, 4) disposed between the control motor 3 and the throttle gear 5, wherein the gear mechanism (3*a*, 4) transmits torque from the control motor 3 to the throttle shaft 2, wherein the pin 5*b* contacts the projection 9*d* at a first contact position 20B when the throttle gear 5 pivots to a predetermined pivot position B in the valve opening direction and wherein the adjustment screw 12 contacts the projection 9*d* at a second contact position 20A when the relief lever 9 pivots to the predetermined pivot position B in the valve closing direction, wherein the first contact position 20B and the second contact position 20A are both located either (i) within a plane P that is perpendicular to the rotational axis L of the throttle shaft 2 or (ii) on the same side of the plane P, wherein the plane P includes a position in which the biasing force of the return spring 11 acts on the relief lever 9, and wherein the position of the relief lever 9 is prevented from tilting as a result of the relief lever 9 moving to the predetermined pivot position B from (i) the valve closing direction or (ii) the valve opening direction.

* * * * *